US005500975A

United States Patent [19]

Sano

[11] Patent Number: 5,500,975

[45] Date of Patent: Mar. 26, 1996

[54] TOOTHBRUSH

[75] Inventor: Kiyoshi Sano, Osaka, Japan

[73] Assignee: Taihei Kogyo Co., Ltd., Osaka, Japan

[21] Appl. No.: 418,594

[22] Filed: Apr. 6, 1995

[30] Foreign Application Priority Data

Apr. 15, 1994 [JP] Japan ..... 6-102260

[51] Int. Cl.[6] ..... A46B 3/16; A46B 9/04

[52] U.S. Cl. ..... 15/167.1; 15/110; 15/195; 15/207.2; 15/DIG. 5; 601/141

[58] Field of Search ..... 15/110, 167.1, 15/195–199, 205, 207.2, DIG. 5; 601/139, 141

[56] References Cited

U.S. PATENT DOCUMENTS

| | | | |
|---|---|---|---|
| 824,087 | 6/1906 | Babcock . | |
| 2,567,080 | 9/1951 | Pifer | 15/167.1 |
| 2,797,424 | 7/1957 | Olson | 15/167.1 |
| 2,978,724 | 4/1961 | Gracian | 15/167.1 |
| 3,103,679 | 9/1963 | Clemens | 15/207.2 |
| 3,840,932 | 10/1974 | Balamuth et al. | 15/195 |
| 4,010,509 | 3/1977 | Huish | 15/167.1 |
| 4,030,158 | 6/1977 | Blair et al. | 15/DIG. 5 |
| 4,161,050 | 7/1979 | Sasaki et al. | 15/DIG. 5 |
| 4,167,794 | 9/1979 | Pomeroy | 15/167.1 |
| 4,472,853 | 9/1984 | Rauch | 15/DIG. 5 |
| 4,475,261 | 10/1984 | Okumura et al. | 15/195 |
| 4,517,701 | 5/1985 | Stanford, Jr. | 15/106 |
| 4,722,111 | 2/1988 | Brodey et al. | 15/207.2 |
| 4,724,569 | 2/1988 | Eguchi et al. | 15/207.2 |
| 5,040,260 | 8/1991 | Michaels | 15/167.1 |
| 5,305,489 | 4/1994 | Lage | 15/167.1 |

FOREIGN PATENT DOCUMENTS

| | | | |
|---|---|---|---|
| 2728672 | 1/1979 | Germany | 15/167.1 |
| 57-50220 | 4/1986 | Japan . | |
| 401903 | 11/1965 | Switzerland | 15/207.2 |
| 2035076 | 6/1980 | United Kingdom | 15/110 |

*Primary Examiner*—Mark Spisich
*Attorney, Agent, or Firm*—Thompson, Hine & Flory

[57] ABSTRACT

A toothbrush having two types of bristle end forms. Filaments, each having a tapered end and a ball-like end, are bundled, and folded in to a U-shape bend in a manner that the tapered end is projected from the ball end. The tapered end is inserted into a periodontal pocket by the projected length.

3 Claims, 3 Drawing Sheets

TOOTHBRUSH

BACKGROUND OF THE INVENTION

1. Field of the Invention

The present invention relates to a toothbrush which is constructed of a bundle of bristles which is folded in a U-shape bend and set into a brush head with each bristle terminated in two different shapes at opposite ends.

2. Description of the Prior Art

There have existed toothbrushes that are adapted for use in tooth brushing with each user's own tooth condition or possibly disorder taken into consideration. For example, some toothbrushes have bristles of which end is terminated in a round shape to massage the gum; to prevent periodontitis or gumboil, some toothbrushes are equipped with bristles each of which is terminated into a tapered-off shape to remove bacterial plaque developed in a small groove (called periodontal pocket) between a tooth and the gum. Most of these toothbrushes are developed with a view to achieving a single purpose, and have thus the corresponding advantage only.

Since health care for the teeth and the gums catches today's health oriented public's attention, there is a need for a toothbrush which has a plurality of functions. To meet such a need, a toothbrush having two types of bristle end shapes has been developed. For example, Japanese Utility Model Open Gazette No. Sho-57-50220 has disclosed such a toothbrush. This toothbrush is provided with two types of bristles, one terminated in a tapered-off shape at its end and the other type having no such taper at its end. Since the tapered end projects further than the other type, the tapered ends are put into contact with the teeth and gums in advance of the other ends and easily reach the periodontal pockets.

Generally speaking, compared to the bristles terminated in other shape, taper ended bristles are subject to deformation. Due to its small elasticity, the taper ended bristle exhibits poor recovery characteristics. This problem may be improved by using thermoplastic polyester as a material of the bristles, to some extent. However, tapered ends of the bristles remain free to be inserted into the periodontal pockets, this aggravates deformation of the bristles. Only a short-time of use is sufficient to keep tapered ends of the bristles deformed. Such a deformed toothbrush provides an adverse effect to the teeth and the gums rather than providing desirable brushing effect to the gums.

SUMMARY OF THE INVENTION

It is an object of the present invention to provide a toothbrush with different types of bristle ends, wherein the toothbrush is arranged so that each type of bristle end performs adequately its intended cleaning function and offers a long service life with the intended cleaning function maintained.

To achieve the above object, the present invention is essentially constructed of bundles of bristles or filaments, with each filament being terminated in different shapes at opposing ends. Each bundle is folded in a U-shaped bend and set into the brush head. The present invention is noticeably different from the above-cited Japanese Utility Model Open Gazette No. Sho-57-50220 in that the Open No. Sho-57-50220 requires that the disclosed toothbrush comprise taper ended bristles while the present invention requires that each end of a bristle be different from the other end of the bristle in shape.

These and other objects, advantages and construction of the present invention will become more apparent when the following detail description is considered with the drawings that follow.

DESCRIPTION OF THE PREFERRED EMBODIMENT

Figure 1:
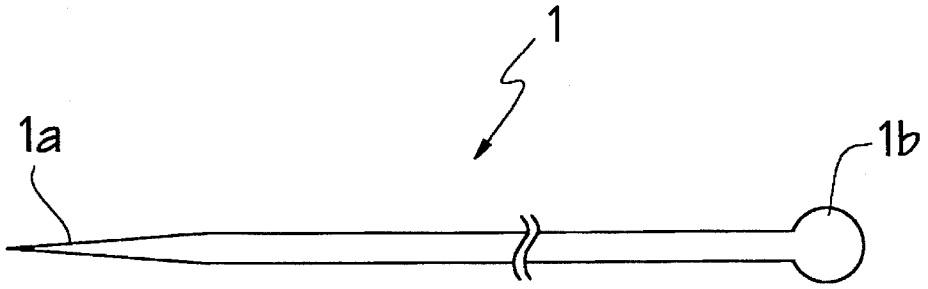
FIG. 1 is a plan view showing an embodiment of the end shapes of a filament in the toothbrush according to the present invention.

Referring now to the drawings, the preferred embodiment of the present invention is discussed.

FIG. 1 is a plan view showing the embodiment of the end shapes of a filament in the toothbrush according to the present invention. The filament 1 is made of an appropriate material as the bristle portions of the toothbrush, cut to an appropriate length, and has one end 1*a* that is tapered off (hereinafter referred to as tapered end 1*a)* and the other end 1*b* that is round in a ball shape (hereinafter referred to as ball end 1*b*). To terminate the filament 1 as above, the filament 1 may be cut accordingly at one end as the tapered end 1*a* and heated and melted at the other end serving as the ball end 1*b*. However, the technique for making the ends of the filament 1 is outside the scope of the present invention, and any appropriate prior art may be employed to produce the end formation of the filament.

The form of the filament 1 in the present invention is not limited to a combination of the tapered end 1*a* and the ball end 1*b* shown in FIG. 1. The present invention includes any form of a filament as long as both ends differ in shape. For example, within the scope of the present invention are a filament terminated in one tapered end 1*a* and the other rounded end and another filament terminated in one ball end 1*b* and the other rounded end. The filament having a transversely flat cut end is not desirable, because the sharp edge of the cut end possibly damages the teeth or the gums.

Figure 2:
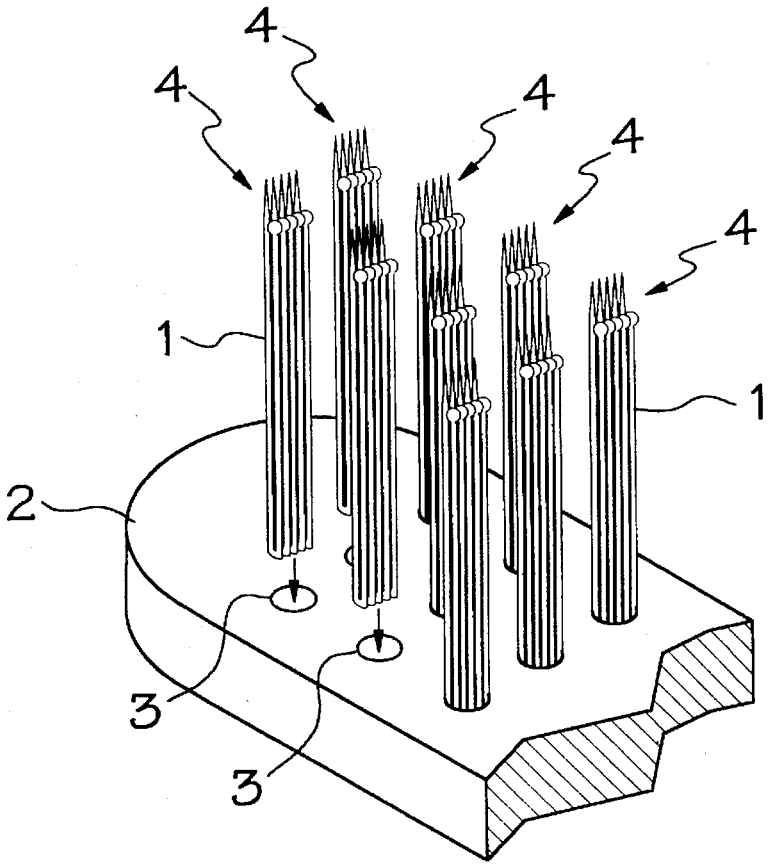
FIG. 2 is a perspective view showing bundles of bristles set into the brush head.
Figure 3:
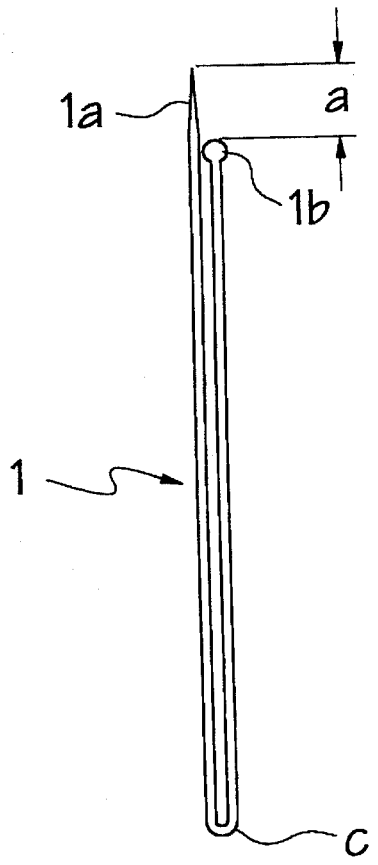
FIG. 3 is a plan view showing the filament folded in a U-shaped bend.

FIG. 2 is a perspective view showing the process of setting the bundles of filaments 1, each terminated in the tapered end and the ball end, into the brush head 2. A plurality of mounting holes 3 are beforehand disposed in the brush head in a manner that permits an appropriate density of bristles. The appropriate number of filaments 1 is formed in bundle to form a plurality of bundles 4 of bristles. Each bundle 4 is folded in a U-shaped bend and then set into the mounting holes 3 in the brush head. This completes the process of the toothbrush according to the present invention. In this case, each bundle 4 is folded at a fold C which not at the center of the bundle but slightly nearer to the ball ends 1*b* than to the tapered ends 1*a*. This arrangement allows the tapered end 1*a* to be projected out of the ball end 1*b* by a difference (a). The advantage of the difference (a) will be described later.

Figure 4:
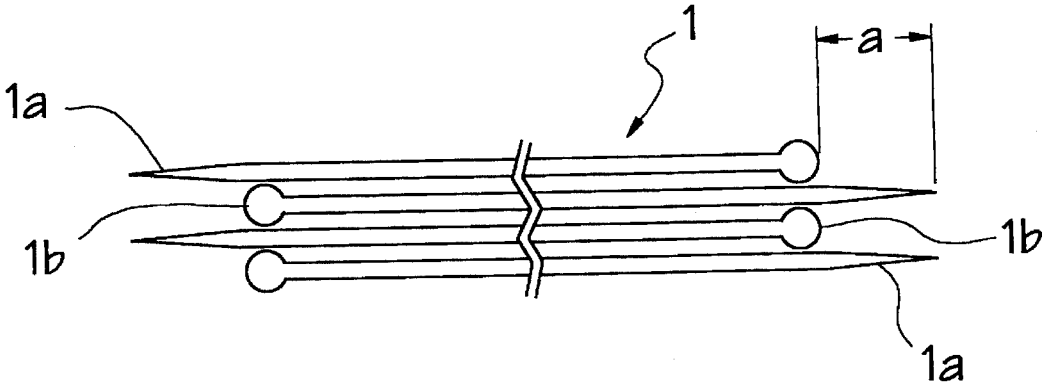
FIG. 4 is a plan view showing another arrangement of the bundles of bristles.

FIG. 4 shows another arrangement of the bundles of bristles. In this arrangement, the bundles 4 are also constructed of the filament 1 already described with reference to FIG. 1. This arrangement in FIG. 4 is different from that in FIG. 2 in that the bundle 4 is formed in a manner that one filament 1 is always opposite to the next filament 1 in their direction with the tapered end 1*a* of the one filament being next to the ball end 1*b* of the next filament 1. The fold of the filament 1 is nearer to its ball end 1*b* so that the difference or projection (a) is created between the tapered end 1*a* and the ball end 1*b*. This is the same as the arrangement in FIG. 2.

A U-shaped folded bundle 4 may be set in the mounting hole 3 by driving a metal wire or metal strip along with the fold C of the bundle 4 into the mounting holes 3. The method of setting the bundles into the brush head is outside the scope of this invention, and any appropriate prior art may be used.

Figure 5:
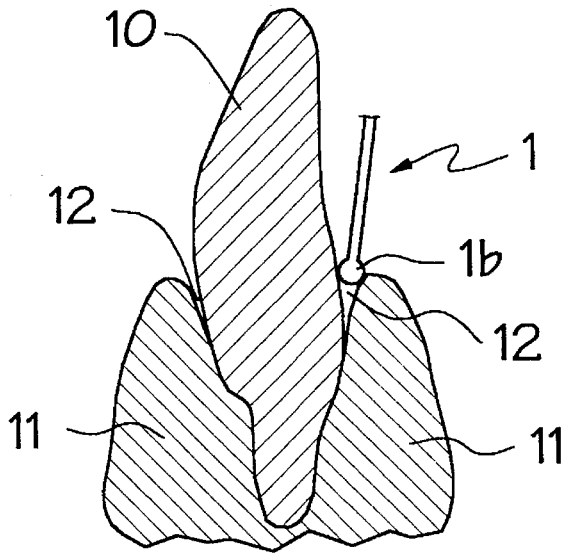
FIGS. 5 and 6 are explanatory views showing how the toothbrush according to the present invention is used.
Figure 6:
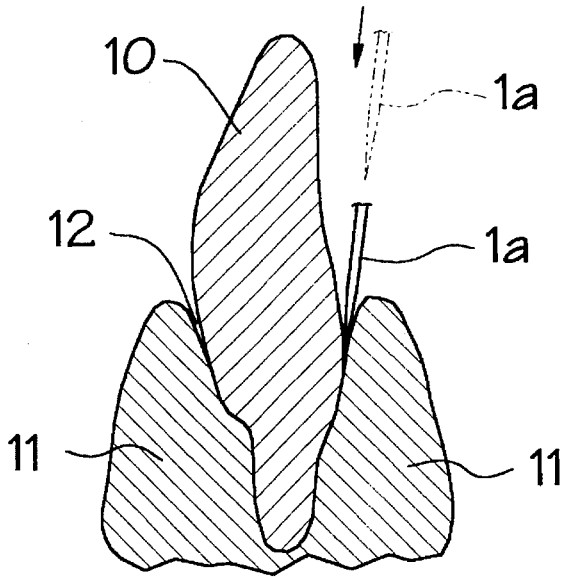

FIGS. 5 and 6 are explanatory views showing how the above-mentioned toothbrush is used. Since the ball end 1*b* is a rounded end of the filament 1, it has massage effect when brushed against the gum 11. The ball end of the filament 1 serves to scrape off dental plaque clung to the surface of a tooth 10. The ball end 1*b* cannot be inserted into the periodontal pockets 12 as shown in FIG. 5. On the other hand, the tapered end 1*a* is mainly designed to be inserted into the periodontal pockets 12 to remove dental plaque therein. Since the toothbrush according to the present invention has the tapered ends 1*a* that are projected from the ball ends 1*b* by the difference (a), the tapered ends la reach into the periodontal pockets 12 without interference from the ball ends 1*b*. This is the reason why the difference (a) is provided between both ends. The difference (a) is preferably equal to or slightly longer than the depth of the periodontal pockets 12. If the difference (a) is too short, the tapered ends 1*a* are unable to reach the bottom of the periodontal pockets 12 and unable to remove dental plaque therein. If the difference (a) is too long, the tapered ends 1*a* are excessively inserted into the periodontal pockets 12 and are deformed. The ball ends 1*b* prevent the tapered ends 1*a* from being excessively inserted into the periodontal pockets 12, and restrict the insertion length of the tapered ends la to the difference (a). The toothbrush according to the present invention provides brushing effect and cleaning function by means of the ball ends 1*b* for a long service life, free from deformation of the tapered ends la that could otherwise take place under slight pressure involved in brushing action. Furthermore, excess insertion of the tapered ends 1*a* is avoided and no damage takes place inside the periodontal pockets 12.

With reference to FIGS. 5 and 6, the ball ends 1*b* have been described as having the function of massaging the gum 11, scraping off dental plaque clung to the surface of the tooth 10, and restricting the excess insertion of the tapered ends 1*a* into the periodontal pockets 12. Also, the tapered ends 1*a* have been described as having the function of removing dental plaque deposited in the periodontal pockets 12. The functions of the ends are not limited to these, but have other known cleaning functions. For example, the ball ends 1*b* serve to clean the cusp of a molar and possibly outperform the tapered ends 1*a* in this function. But the tapered ends 1*a* serve to clean spaces between teeth or corners in the oral cavity, and possibly outperform the ball ends 1*b* in this function.

The combination of the tapered end 1*a* and the ball end 1*b* has been described as one possible form of filament. Other forms of filament are contemplated; for example, a filament constructed of a combination of the tapered end 1*a* and a rounded end or a combination of the ball end 1*b* and a rounded end may be employed. When the tapered end 1*a* is employed, the filament is desirably folded in a U-shape bend when it is set into the brush head, so that the tapered end 1*a* is slightly projected from the rounded end. This allows the tapered end 1*a* to be easily inserted into the periodontal pockets 12 as already described.

What is claimed is:

1. A toothbrush comprising:

a brush head; and bundles of filaments, said bundles of filaments each being folded into a U-shaped bend and set in said brush head, each of said filaments having a first end, and a second end shaped differently than said first end, said filaments being folded at a location intermediate said first and second ends;

wherein each said first end is tapered off and sized so that it is adapted to be inserted into a periodontal pocket, and each said second end is shaped into a ball, such that each said first end extends a distance from the respective second end.

2. The toothbrush according to claim 1, wherein each said first end extends a distance from the respective second end by a length that approximates a depth of the periodontal pocket.

3. The toothbrush according to claim 1, wherein each said second end is sized so that it cannot be adapted to be inserted into the periodontal pocket.

* * * * *